US009119443B2

(12) United States Patent
Barker et al.

(10) Patent No.: US 9,119,443 B2
(45) Date of Patent: Sep. 1, 2015

(54) LOOP-ENGAGEABLE FASTENERS AND RELATED SYSTEMS AND METHODS

(75) Inventors: James R. Barker, Francestown, NH (US); Christopher M. Gallant, Nottingham, NH (US)

(73) Assignee: Velcro Industries B.V., Willemstad (CW)

( * ) Notice: Subject to any disclaimer, the term of this patent is extended or adjusted under 35 U.S.C. 154(b) by 472 days.

(21) Appl. No.: 13/525,521

(22) Filed: Jun. 18, 2012

(65) Prior Publication Data

US 2013/0052403 A1 Feb. 28, 2013

Related U.S. Application Data

(60) Provisional application No. 61/527,361, filed on Aug. 25, 2011.

(51) Int. Cl.
*A44B 18/00* (2006.01)

(52) U.S. Cl.
CPC ..... *A44B 18/0003* (2013.01); *A44B 18/0023* (2013.01); *Y10T 428/24008* (2015.01)

(58) Field of Classification Search
CPC ..... A44B 18/0003; A44B 18/0023
USPC ..... 156/148
See application file for complete search history.

(56) References Cited

U.S. PATENT DOCUMENTS

| | | | |
|---|---|---|---|
| RE18,001 | E | 3/1931 | Rayner |
| 2,706,324 | A | 4/1955 | Cogovan |
| 3,047,444 | A | 7/1962 | Harwood |
| 3,348,992 | A | 10/1967 | Cochran, II |
| 3,408,417 | A | 10/1968 | Sogawa et al. |
| 3,496,260 | A | 2/1970 | Guenther et al. |
| 3,535,178 | A | 10/1970 | Parlin et al. |
| 3,577,607 | A | 5/1971 | Ikoma et al. |
| 3,674,618 | A | 7/1972 | Spann |
| 3,694,867 | A | 10/1972 | Stumpf |
| 3,704,191 | A | 11/1972 | Buresh et al. |
| 3,705,065 | A | 12/1972 | Stumpf |
| 3,708,361 | A | 1/1973 | Stumpf |
| 3,819,462 | A | 6/1974 | Starr et al. |
| 3,822,162 | A | 7/1974 | Stumpf |
| 3,940,525 | A | 2/1976 | Ballard |
| 3,949,128 | A | 4/1976 | Ostermeier |

(Continued)

FOREIGN PATENT DOCUMENTS

| | | |
|---|---|---|
| DE | 101 39 842 | 4/2003 |
| EP | 0 341 993 | 11/1989 |

(Continued)

OTHER PUBLICATIONS

International Search Report and Written Opinion of PCT/US2012/042907 mailed Nov. 2, 2012 (18 pp).

(Continued)

*Primary Examiner* — Jeff Aftergut
(74) *Attorney, Agent, or Firm* — Fish & Richardson P.C.

(57) ABSTRACT

A method of making a sheet-form loop-engageable fastener product includes placing a layer of staple fibers on a first side of a substrate, needling fibers of the layer through the substrate to form loops extending from a second side of the substrate, removing end regions from at least some of the loops to form stems, and forming loop-engageable heads at free ends of at least some of the stems.

28 Claims, 9 Drawing Sheets

(56) References Cited

U.S. PATENT DOCUMENTS 3,950,587 A 4/1976 Colijn et al.
4,001,472 A 1/1977 Thomas et al.
4,010,302 A 3/1977 Anderson et al.
4,035,533 A 7/1977 Chambley
4,116,892 A 9/1978 Schwarz
4,131,704 A 12/1978 Erickson et al.
4,154,885 A 5/1979 Tecl et al.
4,154,889 A 5/1979 Platt
4,169,303 A * 10/1979 Lemelson ..... 24/452
4,192,086 A 3/1980 Sichak
4,223,059 A 9/1980 Schwarz
4,258,094 A 3/1981 Benedyk
4,258,097 A 3/1981 Benedyk
4,295,251 A 10/1981 Tatham et al.
4,315,965 A 2/1982 Mason et al.
4,320,167 A 3/1982 Wishman
4,324,824 A 4/1982 Narens et al.
4,342,802 A 8/1982 Pickens, Jr. et al.
4,363,845 A 12/1982 Hartmann
4,377,889 A 3/1983 Tatham et al.
4,379,189 A 4/1983 Platt
4,389,442 A 6/1983 Pickens, Jr. et al.
4,389,443 A 6/1983 Thomas et al.
4,391,866 A 7/1983 Pickens, Jr. et al.
4,418,104 A 11/1983 Kiyomura et al.
4,439,476 A 3/1984 Guild
4,446,189 A 5/1984 Romanek
4,451,314 A 5/1984 Knoke et al.
4,451,315 A 5/1984 Miyazaki
4,490,425 A 12/1984 Knoke et al.
4,521,472 A 6/1985 Gold
4,536,439 A 8/1985 Forsten
4,600,605 A 7/1986 Nakai et al.
4,600,618 A 7/1986 Raychok, Jr. et al.
4,609,581 A 9/1986 Ott
4,645,699 A 2/1987 Neveu
4,654,246 A 3/1987 Provost et al.
4,750,443 A 6/1988 Blaustein et al.
4,761,318 A 8/1988 Ott et al.
4,770,917 A * 9/1988 Tochacek et al. ..... 428/95
4,931,343 A 6/1990 Becker et al.
4,973,326 A 11/1990 Wood et al.
5,032,122 A 7/1991 Noel et al.
5,066,289 A 11/1991 Polski
5,080,951 A 1/1992 Guthrie
5,144,730 A 9/1992 Dilo
5,216,790 A 6/1993 Eschenbach
5,254,194 A 10/1993 Ott et al.
5,256,231 A 10/1993 Gorman et al.
5,265,954 A 11/1993 Keil
5,304,162 A 4/1994 Kuen
5,307,616 A 5/1994 Goineau et al.
5,320,890 A 6/1994 Anton et al.
5,326,612 A 7/1994 Goulait
5,379,501 A 1/1995 Goineau
5,380,313 A 1/1995 Goulait et al.
5,380,580 A 1/1995 Rogers et al.
5,382,461 A 1/1995 Wu
5,383,872 A 1/1995 Roessler et al.
5,386,595 A 2/1995 Kuen et al.
5,391,424 A 2/1995 Kolzer
5,403,302 A 4/1995 Roessler et al.
5,407,439 A 4/1995 Goulait
5,407,722 A 4/1995 Peake, III et al.
5,417,902 A 5/1995 Bennie et al.
5,423,789 A 6/1995 Kuen
5,447,590 A 9/1995 Gilpatrick
5,449,530 A 9/1995 Peake, III et al.
5,459,991 A 10/1995 Nabeshima et al.
5,470,417 A 11/1995 Goulait
5,476,702 A 12/1995 Datta et al.
5,500,268 A 3/1996 Billarant
5,515,583 A 5/1996 Higashinaka
5,518,795 A 5/1996 Kennedy et al.
5,531,732 A 7/1996 Wood
5,542,942 A 8/1996 Kline et al.
5,547,531 A 8/1996 Allen et al.
5,554,239 A 9/1996 Datta et al.
5,569,233 A 10/1996 Goulait
5,571,097 A 11/1996 Seth
5,595,567 A 1/1997 King et al.
5,599,601 A 2/1997 Polski et al.
5,603,708 A 2/1997 Seth
5,605,729 A 2/1997 Mody et al.
5,611,789 A 3/1997 Seth
5,611,791 A 3/1997 Gorman et al.
5,614,232 A 3/1997 Torigoe et al.
5,614,281 A 3/1997 Jackson et al.
5,615,460 A 4/1997 Weirich et al.
5,616,155 A 4/1997 Kronzer
5,616,394 A 4/1997 Gorman et al.
5,620,779 A 4/1997 Levy et al.
5,622,578 A 4/1997 Thomas
5,624,427 A 4/1997 Bergman et al.
5,630,896 A 5/1997 Corbin et al.
5,643,397 A 7/1997 Gorman et al.
5,647,864 A 7/1997 Allen et al.
5,654,070 A 8/1997 Billarant
5,660,911 A 8/1997 Tesch
5,669,593 A 9/1997 Kirchner
5,669,900 A 9/1997 Bullwinkel et al.
5,669,901 A 9/1997 LaFortune et al.
5,672,222 A 9/1997 Eschenbach
5,685,756 A 11/1997 Noda
5,686,163 A 11/1997 Tsubata et al.
5,692,949 A 12/1997 Sheffield et al.
5,695,845 A * 12/1997 Ogawa et al. ..... 428/93
5,699,593 A 12/1997 Jackson
5,707,707 A 1/1998 Burnes et al.
5,707,906 A 1/1998 Eschenbach
5,722,968 A 3/1998 Datta et al.
5,732,453 A 3/1998 Dilo et al.
5,736,214 A 4/1998 Billarant
5,759,926 A 6/1998 Pike et al.
5,763,041 A 6/1998 Leak et al.
5,766,723 A 6/1998 Oborny et al.
5,773,120 A 6/1998 Deka et al.
5,786,060 A 7/1998 Takahashi et al.
5,814,390 A 9/1998 Stokes et al.
5,830,298 A 11/1998 Jackson
5,843,057 A 12/1998 McCormack
5,858,515 A 1/1999 Stokes et al.
5,866,222 A 2/1999 Seth et al.
5,888,607 A 3/1999 Seth et al.
5,891,547 A 4/1999 Lawless
5,904,793 A 5/1999 Gorman et al.
5,931,823 A 8/1999 Stokes et al.
5,945,215 A 8/1999 Bersted et al.
5,953,797 A 9/1999 Provost et al.
5,962,102 A 10/1999 Sheffield et al.
5,962,112 A 10/1999 Haynes et al.
5,964,742 A 10/1999 McCormack et al.
5,997,981 A 12/1999 McCormack et al.
6,051,094 A 4/2000 Melbye et al.
6,086,984 A 7/2000 DiMaggio, Jr. et al.
6,087,279 A 7/2000 Laun
6,093,665 A 7/2000 Sayovitz et al.
6,129,879 A 10/2000 Bersted et al.
6,129,964 A 10/2000 Seth
6,158,097 A 12/2000 Dilo
6,161,269 A 12/2000 Dilo et al.
6,162,522 A 12/2000 Deka et al.
6,192,556 B1 2/2001 Kikko et al.
6,195,850 B1 3/2001 Melbye et al.
6,248,276 B1 6/2001 Parellada et al.
6,265,053 B1 7/2001 Kronzer et al.
6,280,670 B1 8/2001 Buzzell et al.
6,329,016 B1 12/2001 Shepard et al.
6,342,285 B1 1/2002 Shepard et al.
6,355,759 B1 3/2002 Sherman et al.
6,368,444 B1 4/2002 Jameson et al.
6,410,138 B2 6/2002 Mleziva et al.
6,454,989 B1 9/2002 Neely et al.
6,489,004 B1 12/2002 Martin et al.

(56) References Cited

U.S. PATENT DOCUMENTS

| | | | | |
|---|---|---|---|---|
| 6,537,935 | B1 | 3/2003 | Seth et al. | |
| 6,558,602 | B1 | 5/2003 | Melbye et al. | |
| 6,598,276 | B2 | 7/2003 | Shepard et al. | |
| 6,638,611 | B2 | 10/2003 | Seth | |
| 6,642,160 | B1 | 11/2003 | Takahashi | |
| 6,642,429 | B1 | 11/2003 | Carter et al. | |
| 6,645,611 | B2 | 11/2003 | Seth | |
| 6,660,202 | B2 | 12/2003 | Shepard et al. | |
| 6,686,303 | B1 | 2/2004 | Haynes et al. | |
| 6,703,086 | B2 | 3/2004 | Kronzer et al. | |
| 6,709,996 | B2 | 3/2004 | Mleziva et al. | |
| 6,716,511 | B2 | 4/2004 | Bersted et al. | |
| 6,740,385 | B2 | 5/2004 | Gardner et al. | |
| 6,756,327 | B2 | 6/2004 | Martin | |
| 6,783,834 | B2 | 8/2004 | Shepard et al. | |
| 6,849,142 | B1 | 2/2005 | Goulait | |
| 6,869,659 | B2 | 3/2005 | Shepard et al. | |
| 6,893,525 | B1 | 5/2005 | Schmidt et al. | |
| 6,948,221 | B2 | 9/2005 | Fuchs | |
| 6,955,847 | B1 | 10/2005 | Itou et al. | |
| 6,991,843 | B2 | 1/2006 | Armela et al. | |
| 7,052,638 | B2 | 5/2006 | Clarner et al. | |
| 7,117,571 | B2 | 10/2006 | Dilo | |
| 7,156,937 | B2 | 1/2007 | Provost et al. | |
| 7,275,290 | B2 | 10/2007 | Clarner et al. | |
| 7,276,642 | B2 | 10/2007 | Belau | |
| 7,282,251 | B2 | 10/2007 | Provost et al. | |
| 7,465,366 | B2 * | 12/2008 | Provost et al. | 156/148 |
| 7,547,469 | B2 | 6/2009 | Provost et al. | |
| 7,562,426 | B2 | 7/2009 | Barker et al. | |
| 2001/0051253 | A1 | 12/2001 | Tai et al. | |
| 2003/0077430 | A1 | 4/2003 | Grimm et al. | |
| 2003/0101549 | A1 | 6/2003 | Wang et al. | |
| 2003/0119404 | A1 | 6/2003 | Belau et al. | |
| 2004/0020579 | A1 | 2/2004 | Durrance et al. | |
| 2004/0022993 | A1 | 2/2004 | Wildeman | |
| 2004/0072491 | A1 | 4/2004 | Gillette et al. | |
| 2004/0131820 | A1 | 7/2004 | Turner | |
| 2004/0157036 | A1 | 8/2004 | Provost et al. | |
| 2004/0163221 | A1 | 8/2004 | Shepard et al. | |
| 2004/0229008 | A1 | 11/2004 | Hoying | |
| 2005/0196580 | A1 | 9/2005 | Provost et al. | |
| 2005/0196581 | A1 | 9/2005 | Provost et al. | |
| 2005/0196583 | A1 | 9/2005 | Provost et al. | |
| 2005/0208259 | A1 | 9/2005 | Provost et al. | |
| 2005/0217092 | A1 | 10/2005 | Barker et al. | |
| 2005/0281976 | A1 | 12/2005 | Curro et al. | |
| 2006/0105664 | A1 | 5/2006 | Zafiroglu | |
| 2006/0183389 | A1 | 8/2006 | Zafiroglu | |
| 2006/0225258 | A1 | 10/2006 | Barker et al. | |
| 2007/0178273 | A1 | 8/2007 | Provost et al. | |
| 2008/0113152 | A1 | 5/2008 | Provost et al. | |
| 2008/0305291 | A1 | 12/2008 | Nakaoka et al. | |
| 2008/0305297 | A1 | 12/2008 | Barker et al. | |
| 2008/0305704 | A1 | 12/2008 | Provost et al. | |
| 2009/0203280 | A9 | 8/2009 | Provost et al. | |
| 2009/0208699 | A1 | 8/2009 | Miyauchi et al. | |

FOREIGN PATENT DOCUMENTS

| | | |
|---|---|---|
| EP | 0 211 564 | 2/1992 |
| EP | 0 482 749 | 4/1992 |
| EP | 0 325 473 | 3/1993 |
| EP | 0 604 731 | 7/1994 |
| EP | 0 619 085 | 10/1994 |
| EP | 0 765 616 | 4/1997 |
| EP | 0 780 066 | 6/1997 |
| EP | 0 780 505 | 6/1997 |
| EP | 0 598 085 | 7/1997 |
| EP | 0 597 075 | 4/1998 |
| EP | 0 882 828 | 12/1998 |
| EP | 0 937 420 | 8/1999 |
| EP | 0 726 977 | 6/2000 |
| EP | 0 862 868 | 6/2001 |
| EP | 1 132 511 | 9/2001 |
| EP | 0 861 137 | 1/2002 |
| EP | 1 279 348 | 1/2003 |
| EP | 1 156 767 | 10/2004 |
| EP | 1 113 099 | 3/2006 |
| EP | 1 689 259 | 12/2008 |
| GB | 1 228 421 | 4/1971 |
| GB | 1228431 | 4/1971 |
| GB | 2 068 023 | 8/1981 |
| GB | 2 285 093 | 6/1995 |
| JP | 6-33359 | 2/1994 |
| JP | 06-123061 | 5/1994 |
| JP | 7-171011 | 7/1995 |
| JP | 08-27657 | 1/1996 |
| JP | 09 003755 | 1/1997 |
| JP | 09-195154 | 7/1997 |
| JP | 09-195155 | 7/1997 |
| JP | 09-241961 | 9/1997 |
| JP | 10-146207 | 6/1998 |
| JP | 10-151005 | 6/1998 |
| JP | 2971332 | 11/1999 |
| JP | 2000-314065 | 11/2000 |
| JP | 2001-212 | 1/2001 |
| JP | 2001-8713 | 1/2001 |
| JP | 3134709 | 2/2001 |
| JP | 2001-207369 | 8/2001 |
| JP | 2001-514346 | 9/2001 |
| JP | 2002-10807 | 1/2002 |
| JP | 2003-265207 | 9/2003 |
| JP | 2004-194730 | 7/2004 |
| JP | 3855084 | 12/2006 |
| JP | 3877842 | 2/2007 |
| WO | WO92/01401 | 2/1992 |
| WO | WO95/17111 | 6/1995 |
| WO | WO 95/20335 | 8/1995 |
| WO | WO98/33410 | 8/1998 |
| WO | WO99/11452 | 3/1999 |
| WO | WO00/40793 | 7/2000 |
| WO | WO00/42964 | 7/2000 |
| WO | WO01/80680 | 1/2001 |
| WO | WO02/100207 | 12/2002 |
| WO | WO03/051251 | 6/2003 |
| WO | WO2004/019305 | 3/2004 |
| WO | WO2004/049853 | 6/2004 |
| WO | WO2004/058118 | 7/2004 |
| WO | WO2004/058497 | 7/2004 |
| WO | WO2004/059061 | 7/2004 |
| WO | WO2004/059117 | 7/2004 |
| WO | WO2005/037006 | 4/2005 |
| WO | WO2006/110575 | 10/2006 |
| WO | WO2006/110598 | 10/2006 |
| WO | WO-2010/030548 A5 * | 3/2010 |

OTHER PUBLICATIONS

Dilo Group, "Market Leadership in Nonwovens Technology", Pakistan Textile Journal, date unknown (2 pages).

Dilo, "Engineering Excellence in Needle Looms!", Hyperpunch—The Solution for Fine and Quality Fleeces, Synthetic Leather, Spunbondeds, Papermachine Felts!, date unknown (2 pages).

Purdy, Terry, Dilo Inc., Needle Punching Benefits from Elliptical Needle Paths, date unknown (13 pages).

Website: http://www.inda.org/pubs/c-papers/np00-toc.html. Inda.org, Needlepunch 2000 conference paper listing, retrieved Sep. 24, 2007. 2 Pages.

Narejo, D., et al, "Advances in Needlepunching", GFR, Jun./Jul. 2002, pp. 18-21.

International Search Report and Written Opinion; Application No. PCT/US2012/042901; mailed Dec. 21, 2012; 12 pages.

* cited by examiner

LOOP-ENGAGEABLE FASTENERS AND RELATED SYSTEMS AND METHODS

CROSS-REFERENCE TO RELATED APPLICATIONS

This application claims the benefit of U.S. application Ser. No. 61/527,361, filed on Aug. 25, 2011, which is incorporated by reference herein.

TECHNICAL FIELD

This invention relates to loop-engageable fasteners and related systems and methods.

BACKGROUND

In woven and knit hook fasteners, hook-forming filaments are included in the structure of a fabric to form upstanding hooks for engaging loops. The cost of woven and knit hook fasteners of this type is a major factor limiting the extent of use of such fasteners.

SUMMARY

In one aspect of the invention, a method of making a sheet-form loop-engageable fastener product includes placing a layer of staple fibers on a first side of a substrate, needling fibers of the layer through the substrate by penetrating the substrate with needles that drag portions of the fibers through the substrate during needling, leaving exposed loops of the fibers extending from a second side of the substrate, removing end regions from at least some of the loops to form stems, and forming loop-engageable heads at free ends of at least some of the stems.

Embodiments can include one or more of the following features.

In some embodiments, the method further includes anchoring fibers forming the loops by fusing the fibers to each other on the first side of the substrate, while substantially preventing fusion of the fibers on the second side of the substrate.

In some embodiments, the needles are sized so that no more than one fiber is needled through the substrate per needle.

In some embodiments, the method further includes matching the needles to the fibers so that each of the needles captures no more than one fiber per needle stroke.

In some embodiments, the needles are fork needles, each fork needle having a recess formed between tines.

In some embodiments, the recess of each needle has a width that is about 75% to about 125% of a diameter of a circle that circumscribes the fibers.

In some embodiments, the recess of each needle has a width of 80-100 microns to capture a single fiber having a titer of 60-110 dtex.

In some embodiments, the needles are 38 gauge fork needles and the fibers have a titer of 70 dtex.

In some embodiments, the needles are 38 gauge fork needles and the fibers have a titer of 110 dtex.

In some embodiments, the fibers are drawn fibers.

In some embodiments, the fibers have a titer of 60-600 dtex.

In some embodiments, the fibers have a titer of 100-600 dtex.

In some embodiments, the staple fibers are disposed on the substrate in a carded, unbonded state.

In some embodiments, the substrate includes a nonwoven web.

In some embodiments, the nonwoven web includes a spunbond web.

In some embodiments, the loops formed on the second side of the substrate are formed such that substantially only one loop protrudes through each hole in the substrate so that the loops extend substantially perpendicular to the substrate.

In some embodiments, removing end regions from at least some of the loops to form stems includes cutting the end regions off with a blade.

In some embodiments, forming loop-engageable heads at the ends of at least some of the stems includes melting the ends of the at least some of the stems.

In some embodiments, melting the ends of at least some of the stems includes applying heat with a hot knife.

In some embodiments, removing end regions and forming loop-engageable heads are performed substantially simultaneously using a single device.

In some embodiments, the formed loops extend 2-8 mm from the substrate.

In some embodiments, the loop-engageable heads have an average diameter that is at least 50% larger than a diameter of a circle that circumscribes the fibers.

In some embodiments, the loop-engageable heads have an average height that is at least 50% larger than a diameter of a circle that circumscribes the fibers.

In some embodiments, needling fibers of the layer through the substrate includes needling fibers to form taller loops and needling fibers to form shorter loops having a second height, and end regions of the taller loops are removed to form the stems.

In some embodiments, needling fibers to form taller loops and needling fibers to form shorter loops having a second height includes using different sized needles disposed along a common needle board.

In some embodiments, needling fibers to form taller loops and needling fibers to form shorter loops having a second height includes using different sized needles disposed along different needle boards of a single needle loom.

In some embodiments, needling fibers to form taller loops and needling fibers to form shorter loops having a second height includes using different sized needles disposed in different needle looms.

In some embodiments, needling fibers to form taller loops and needling fibers to form shorter loops having a second height includes using different needle looms having the same sized needles and moving each needle board of each needle loom different distance.

In some embodiments, needling fibers to form taller loops and needling fibers to form shorter loops having a second height includes using crown needles and forked needles disposed along a common needle board.

In some embodiments, the loops and the stems with loop-engageable heads are substantially evenly distributed along the substrate.

In some embodiments, the ratio of loops to stems with loop-engageable heads disposed along the substrate is 1:1 to 3:1.

In some embodiments, the first height is 5-8 mm and the second height is 2-4 mm.

In some embodiments, at least some of the loop-engageable heads extend from the substrate to a distance that is within 10% of a distance that the loops extend from the substrate.

In some embodiments, discrete patterns of larger loops are formed during needling to form pairs of stems with loop-engageable heads along the substrate.

In some embodiments, needling the fibers of the layer through the substrate includes selectively needling the fibers to form discrete regions of loops.

In some embodiments, the discrete regions include islands that include groupings of multiple loops that are surrounded by regions free of loops.

In some embodiments, the discrete regions include lanes of loops, the lanes being separated by parallel regions that are free of loops.

In some embodiments, selectively needling the fibers to form discrete regions of loops includes moving needles different distances with respect to the substrate such that a first portion of needles push some fibers through the substrate to form the loops and a second portion of needles do not penetrate the substrate.

In some embodiments, selectively needing the fibers to form discrete regions of loops includes using needle boards having discrete regions of needles that are separated by regions that are free of needles.

In some embodiments, selectively needing the fibers to form discrete regions of loops includes passing the substrate and fibers through more than one needle loom, each needle loom having a different pattern of needles disposed along a needle board.

In another aspect of the invention, a sheet-form loop product includes a substrate and staple fibers anchored on a first side of the substrate and having exposed fiber stems with loop-engageable heads extending from a second side of the substrate, where the fibers on the first side of the substrate are fused together to a relatively greater extent than the fibers on the second side of the substrate and pairs of the fibers extend through respective openings in the substrate.

In a further aspect of the invention, a processing machine includes a needling station to penetrate a substrate with needles to drag portions of staple fibers disposed along a first side of the substrate through the substrate in order to leave exposed loops of the fibers extending from a second side of the substrate, a device configured to remove loop-ends of the loops to form the loops into stems, and a melting station configured to melt free ends of the stems to form loop-engageable heads at the ends of at least some of the stems.

Embodiments can include one or more of the following features.

In some embodiments, the device configured to remove loop-ends includes a blade.

In some embodiments, the melting station includes a heated blade.

In some embodiments, the needles include tines defining a recess therebetween, the recess being sized to capture no more than one of the fibers.

In some embodiments, the recess has a width of 100 to 200 microns.

In some embodiments, the processing machine further includes a laminating station to anchor fibers forming the loops by fusing the fibers to each other on the first side of the substrate.

In an additional aspect of the invention, a processing machine includes a needling station to penetrate a substrate with needles to drag portions of staple fibers disposed along a first side of the substrate through the substrate in order to leave exposed loops of the fibers extending from a second side of the substrate, and a device configured to remove loop-ends of the loops to form the loops into stems and to melt free ends of the stems to form loop-engageable heads at the ends of at least some of the stems.

Embodiments can include one or more of the following features.

In some embodiments, the device is configured to remove the loop-ends of the loops and melt the free ends of the stems to form the loop-engageable heads substantially simultaneously.

In certain embodiments, the device configured to remove loop-ends of the loops to form the loops into stems and to melt free ends of the stems to form loop-engageable heads at the ends of at least some of the stems includes a hot wire.

In some embodiments, the processing machine further includes a laminating station to anchor fibers forming the loops by fusing the fibers to each other on the first side of the substrate.

Embodiments can include one or more of the following advantages.

Methods described herein can be used to form loop-engageable fastener products that are relatively inexpensive, drapeable and strong. The sheet-form loop-engageable fastener products formed in this manner can also have a much greater width or surface area than similar fastener products formed using conventional techniques, such as continuous molding techniques. Thus, the methods described herein can be particularly advantageous for applications in which large widths or surface areas are preferred (e.g., for fastening siding to a home, for fastening membrane roofing, etc.).

Pushing one fiber per needle through the substrate can create a more even distribution of fiber loops that can be sheared and melted to form mushroom-shaped fastener elements. Since the loops, and therefore the resulting stems, are substantially evenly distributed during the needling process, it is less likely that adjacent stems will be in contact when the stems are melted to form mushroom caps, thus reducing the likelihood of adjacent fastener elements melting together. Forming a single loop per needle can also help ensure that the loops stand proud and thus prevent multiple loops from crossing each other. This likewise helps to ensure that when mushroom-shaped fastener elements are formed, the needled fibers do not melt together.

Needling the fibers in a manner such that only one fiber per needle is pushed through the substrate can also increase (e.g., maximize) the number of fibers that remain on the backside of the substrate. By increasing the number of fibers that remain on the backside of the substrate, more of those fibers are available for bonding to and anchoring the fibers that are pushed through to the front side of the substrate in the form of loops. As a result, the fibers that are pushed through to the front side of the substrate can be more securely anchored to the substrate, which results in higher closure strength.

Additionally, by creating the mushroom-shaped fastener elements in the manner described above, it is possible to manufacture materials having loop-engageable fastener elements disposed in various patterns and/or configurations in a more cost effective manner than many conventional techniques. For example, forming the sheet-form loop-engageable fastener product to include discrete regions of mushroom-shaped fastener elements can reduce the amount of fibers required to create the fastener product. In addition, the discrete regions can be shaped, designed and/or positioned along the fastener product to achieve various aesthetic and/or functional design goals.

Pushing loops through substrate to different degrees allows for creating a fastener product including both loops and loop-engageable fastener elements. Such a fastener product can be used to engage a hook material, a loop material, or a similar hook/loop material. Additionally or alternatively, the fastener product can be self-engaging (e.g., foldable to engage itself).

Using drawn staple fibers can result in mushroom-shaped fastener elements that are highly loop-engageable because the alignment of the polymer chains in the drawn fibers causes them to melt substantially uniformly to provide a wider engaging portion.

Other features, objects, and advantages of the invention will be apparent from the description and drawings, and from the claims.

DETAILED DESCRIPTION

In some aspects of the invention, methods of forming mushroom-shaped loop-engageable fastener products include placing a layer of staple fibers on a first side of a substrate, needling fibers of the layer through the substrate by penetrating the substrate with needles that drag portions of the fibers through the substrate to form loops extending from a second side of the substrate, removing end regions from at least some of the loops to form stems, and forming loop-engageable heads at free ends of at least some of the stems. Such methods can be used to produce relatively inexpensive, flexible, drapeable, and strong loop-engageable fastener products. In addition, the fastener products can be formed to have significantly larger widths and surface areas than many loop-engageable fastener products formed using continuous molding techniques that utilize mold rolls, which tend to bow above a certain length.

Figure 1:
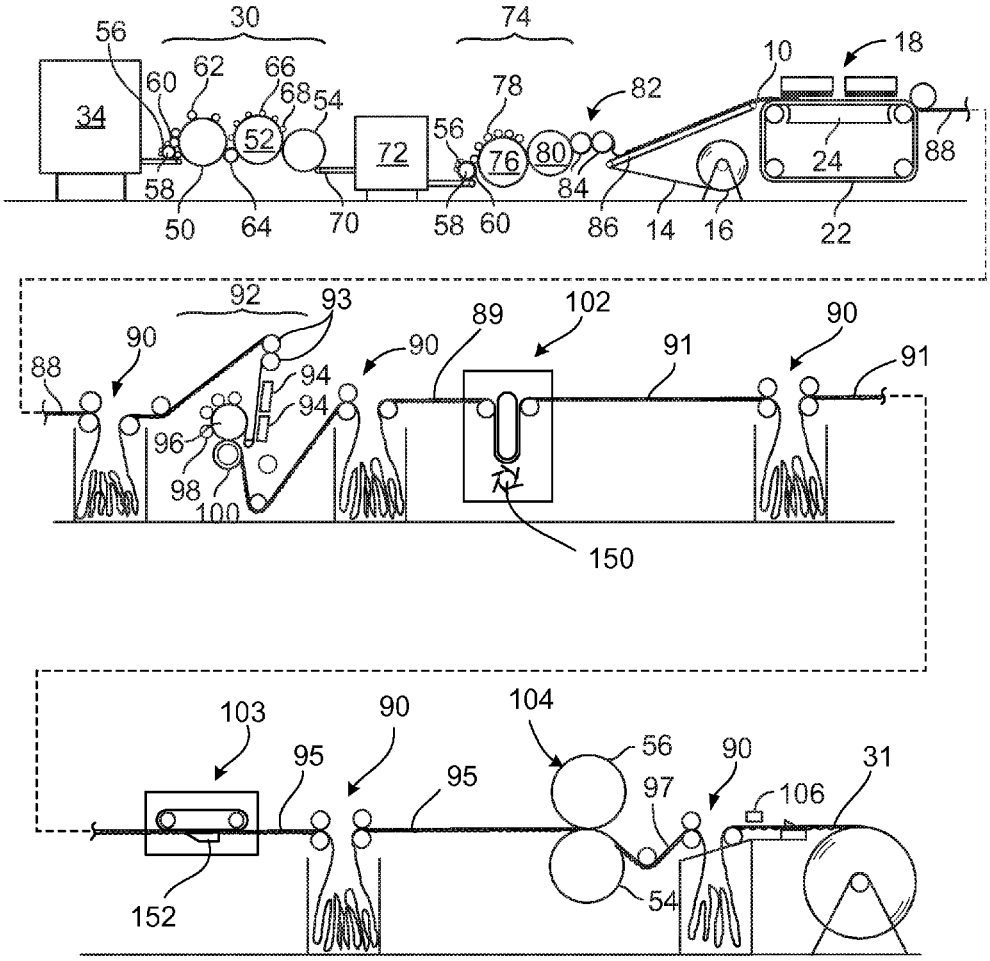
FIG. 1 is a diagrammatic view of a process for forming mushroom-shaped loop-engageable fastener products.

FIG. 1 illustrates a machine and process for producing an inexpensive loop-engageable touch fastener product 31. Beginning at the upper left end of FIG. 1, a carded and cross-lapped layer of staple fibers 10 is created by two carding stages with intermediate cross-lapping. Weighed portions of staple fibers are fed to a first carding station 30 by a card feeder 34. The carding station 30 includes a 36-inch breast roll 50, a 60-inch breaker main 52, and a 50-inch breaker doffer 54. The first card feedroll drive includes 3-inch feedrolls 56 and a 3-inch cleaning roll on a 13-inch lickerin roll 58. An 8-inch angle stripper 60 transfers the fiber to breast roll 50. There are three 8-inch worker roll sets 62 on the breast roll 50, and a 16-inch breast doffer 64 feeds the breaker main 52, against which seven 8-inch worker sets 66 and a flycatcher 68 run. The carded fibers are combed onto a conveyer 70 that transfers the single fiber layer into a cross-lapper 72.

Before cross-lapping, the carded fibers still appear in bands or streaks of single fiber types, corresponding to the fibrous balls fed to carding station 30 from the different feed bins. Cross-lapping, which normally involves a 90-degree reorientation of line direction, overlaps the fiber layer upon itself and is adjustable to establish the width of fiber layer fed into a second carding station 74. In this example, the cross-lapper output width is set to approximately equal the width of the carrier into which the fibers will be needled. Cross-lapper 72 may have a lapper apron that traverses a floor apron in a reciprocating motion. The cross-lapper 72 lays carded webs of, for example, about 80 inch (2.0 meter) width and about one-half inch (1.3 centimeter) thickness on the floor apron to build up several layers of criss-crossed web, forming a layer of, for instance, about 80 inches (2.0 meters) in width and about 4 inches (10 centimeters) in thickness, that includes four double layers of carded web.

During carding, the fibers are separated and combed into a cloth-like mat consisting primarily of parallel fibers. With nearly all of its fibers extending in the carding direction, the mat has some strength when pulled in the carding direction but almost no strength when pulled in the carding cross direction, as cross direction strength results only from a few entanglements between fibers. During cross-lapping, the carded fiber mat is laid in an overlapping zigzag pattern, creating a mat 10 of multiple layers of alternating diagonal fibers. The diagonal layers, which extend in the carding cross direction, extend more across the apron than they extend along its length. Cross-lapping the web before the second carding process provides several tangible benefits. For example, it enhances the blending of the fiber composition during the second carding stage. It also allows for relatively easy adjustment of web width and basis weight, simply by changing cross-lapping parameters.

The second carding station 74 takes the cross-lapped mat of fibers and cards them a second time. The feedroll drive consists of two 3-inch feed rolls and a 3-inch cleaning roll 56 on a 13-inch lickerin 58, feeding a 60-inch main roll 76 through an 8-inch angle stripper 60. The fibers are worked by six 8-inch worker rolls 78, the last five of which are paired with 3-inch strippers. A 50-inch finisher doffer 80 transfers the carded web to a condenser 82 having two 8-inch condenser rolls 84, from which the web is combed onto a non-woven carrier sheet 14 fed from a spool 16. The condenser typically increases the basis weight of the web and reduces the orientation of the fibers to remove directionality in the strength or other properties of the finished product.

The fibers are coarse, crimped polypropylene fibers having a titer of 60-600 dtex (e.g., 70-110 dtex) that are about a three-inch (75 millimeters) staple length. The use of such coarse fibers helps to ensure that the loops, stems, and mushroom-shaped fastener elements produced in subsequent processing steps stand straight up during manufacturing. The fibers have a round cross-sectional shape and are crimped at about 10-13 crimps per inch (4-5 crimps per centimeter). The fibers are in a drawn, molecular oriented state, having been drawn under cooling conditions that enable molecular orientation to occur. Fibers can be drawn to a variety of draw ratios. In some cases, the draw ratio is 1:4.5 to 1:5.5, pre-drawn length to final length. The draw ratio has been found useful for altering the subsequent formation of mushroom-shaped fastener elements. Suitable polypropylene fibers are available from Asota Ges.m.b.H. of Linz, Austria (www.Asota.com) as type G10C.

The carrier sheet 14 is typically a nonwoven web (e.g., a spunbond web). Spunbond webs, and other suitable nonwoven webs, include continuous filaments that are entangled and fused together at their intersections (e.g., by hot calendaring). In order to adequately support needled loops and subsequently formed mushroom-shaped fastener elements that protrude from the carrier sheet 14, the carrier sheet 14 is relatively heavier than substrate materials that are used to form certain conventional loop materials, and has a basis weight that ranges from 30-100 grams per square meter (gsm). In some embodiments, the carrier sheet 14 has a basis weight of about 68 gsm (2.0 ounces per square yard (osy)). While maintaining proper structural requirements, the carrier sheet 14 is also relatively lightweight and inexpensive as compared to materials used to form many woven and knit hook products. To optimize anchoring of the hooks during subsequent lamination, it is desirable that the fibers fuse not only to themselves on the back side of the carrier sheet 14, but also to the filaments of the carrier sheet 14. Suitable carrier sheet materials include nylons, polyesters, polyamides, polypropylenes, EVA, and their copolymers.

The carrier sheet 14 may be supplied as a single continuous length, or as multiple, parallel strips. For particularly wide webs, it may be necessary or cost effective to introduce two or more parallel sheets, either adjacent or slightly overlapping. The parallel sheets may be unconnected or joined along a mutual edge. The carded, uniformly blended layer of fibers from condenser 82 is carried up conveyor 86 on carrier sheet 14 and into needling station 18 in the form of a mat 10. As the fiber layer or mat 10 enters the needling station, it has no stability other than what may have been imparted by carding and cross-lapping. In other words, the fibers are not pre-needled or felted prior to reaching a subsequent needling station 18. In this state, the fiber layer or mat 10 is not suitable for spooling or accumulating.

In the needling station 18, the carrier sheet 14 and fiber layer 10 are needle-punched from the fiber side. Forked needles are guided through a stripping plate above the fibers, and draw fibers through the carrier sheet 14 to form loops on the opposite side.

During needling, the carrier sheet 14 is supported on a bed of bristles extending from a driven support belt or brush apron 22 that moves with the carrier sheet 14 through the needling station 18. Reaction pressure during needling is provided by a stationary reaction plate 24 underlying the support belt or brush apron 22. The needling station 18 typically needles the fiber-covered carrier sheet 14 with an overall penetration density of about 80 to 160 punches per square centimeter. During needling, the thickness of the carded fiber layer 10 only decreases by about half, as compared with felting processes in which such a fiber layer thickness decreases by one or more orders of magnitude. As fiber basis weight decreases, needling density may need to be increased.

The needling station 18 may be a "structuring loom" configured to subject the fiber layer 10 and carrier sheet 14 to a random velouring process. Thus, the needles penetrate a moving bed of bristles of the brush apron 22. The brush apron 22 may have a bristle density of about 2000 to 3000 bristles per square inch (310 to 465 bristles per square centimeter) (e.g., about 2570 bristles per square inch (400 per square centimeter)). The bristles are typically each about 0.018 inch (0.46 millimeter) in diameter and about 20 millimeters long, and are preferably straight. The bristles may be formed of any suitable material, for example 6/12 nylon. Suitable brushes may be purchased from Stratosphere, Inc., a division of Howard Brush Co., and retrofitted onto DILO and other random velouring looms. Generally, the brush apron moves at the desired line speed.

As discussed below, the forked needles of the needling station 18 are typically sized to match the size of the intended fibers of the fiber layer 10, or vice versa, to ensure that only one fiber is typically needled through the carrier sheet 14 per needle. More specifically, the width of a recess formed between tines of the forked needle is about 0.75 to about 1.25 times the average diameter of the fiber or, in the case of fibers that do not have a circular cross-section, about 0.75 to about 1.25 times the diameter of the smallest imaginary circle capable of circumscribing the fiber.

Figure 2A:
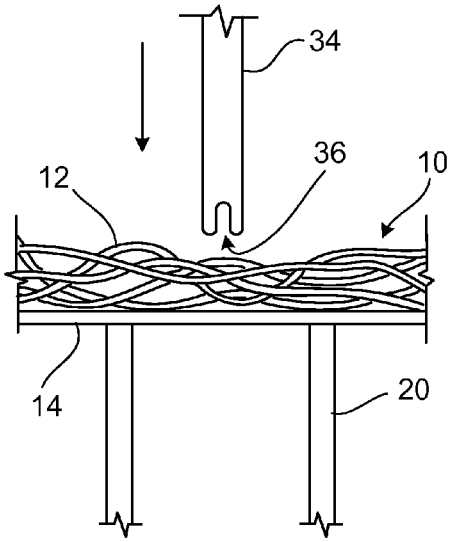
FIGS. 2A-2C are diagrammatic, cross-sectional side views of stages of a needling step of the process of FIG. 1.
Figure 2B:
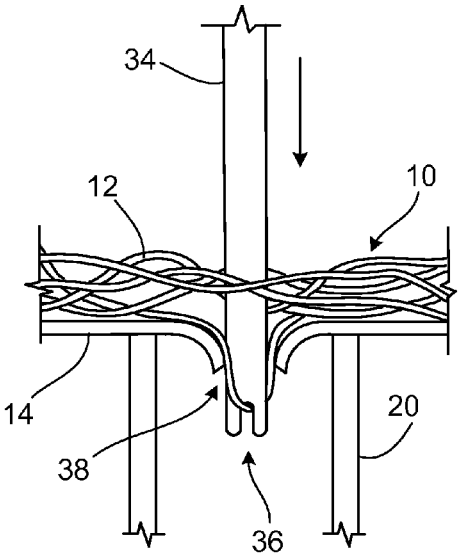
Figure 2C:
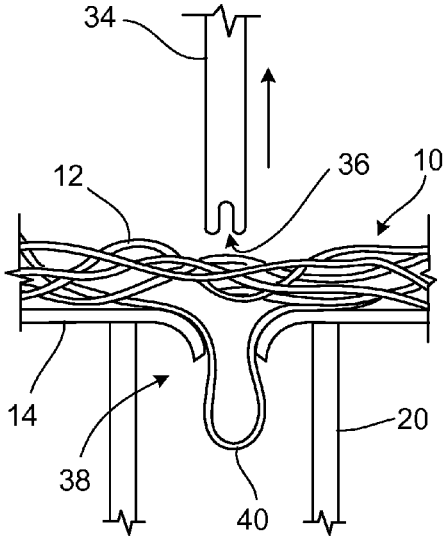

FIGS. 2A through 2C sequentially illustrate the formation of a loop structure that, as described below, can be subsequently processed to form mushroom-shaped loop-engageable fastener elements. Referring to FIG. 2A, during the needling process, a forked needle 34 of the needling station 18 is moved downward toward the fiber mat 10.

As the needle 34 pierces the carrier sheet 14, as shown in FIG. 2B, one individual fiber 12 is captured in a recess 36 formed between two tines in the forked end of the needle 34 and the captured fiber 12 is drawn with the needle 34 through a hole or opening 38 formed in the carrier sheet 14 to the other side (e.g., the front side) of the carrier sheet 14. The carrier sheet 14 remains generally supported by bristles 20 of the brush apron 22 through this process, and the penetrating needle 34 enters a space between adjacent bristles 20. As the needle 34 continues to penetrate, tension is applied to the captured fiber 12, drawing the mat 10 down against the carrier sheet 14. Typically, the needles 34 are operated in a manner to achieve a total penetration depth "$D_P$" of 3.0 to 12.0 millimeters (e.g., 4.0 to 6.0 millimeters), as measured from the entry surface of carrier sheet 14. Penetration depths in this range have been found to provide a well-formed loop structure without overly stretching fibers in the remaining mat. Excessive penetration depth can draw loop-forming fibers from earlier-formed tufts, resulting in a less robust loop field.

When the needle 34 is retracted, as shown in FIG. 2C, the portions of the captured fiber 12 carried to the opposite side of the carrier web remain in the form of an individual loop 40 trapped in the hole 38 formed in the carrier sheet 14. The final loop formation typically has an overall height "$H_L$" of about 3.5 to 6.0 millimeters so that after the loop undergoes additional processing steps (e.g., shearing loops into stems and melting stem ends to form mushroom-shaped fastener elements), the final height of the mushroom-like hook fastener will be approximately 2.0 to 5.0 millimeters for engagement with commonly sized female fastener elements.

Figure 3:
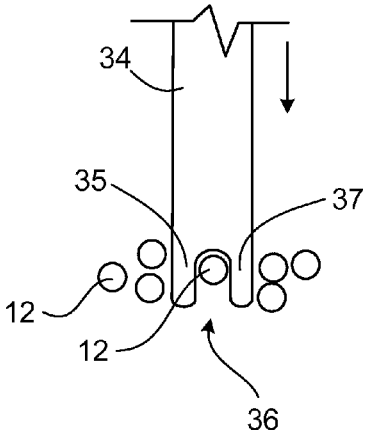
FIG. 3 is an enlarged view of a needle fork capturing a fiber during the needling process illustrated in FIGS. 2A-2C.

As mentioned above, the needles 34 used to push the fibers 12 through the carrier sheet 14 each have a recess 36 that is sized and configured so that only one fiber 12 is typically captured by each needle when the needles 34 penetrate through the fiber mat 10 and the carrier sheet 14. FIG. 3 schematically illustrates one of the needles 34 penetrating the fiber layer 10 in a manner so that only one of the fibers 12 is received in the recess 36 formed between tines 35 and 37 of the needle 34 to ensure that only one fiber is needled through the carrier sheet 14 by that particular fork needle 34. In order to capture substantially only one fiber during needling, the recess 36 is sized to have a width and depth that are approximately 75%-125% of the average diameter of the fibers. For example, a 38 gauge forked needle having a 100 micron recess, as measured between the inner surfaces of the two tines, is used to capture 70 dtex or 110 dtex round fibers. Due to the standard sizing of forked needles and fibers, other combinations of fibers and needles can be utilized. By capturing only one fiber 12 when the forked needle fully penetrates the fiber mat 10 and the carrier sheet 14, typically only one loop is formed on the front side of the carrier sheet 14. Forming only one loop at a time typically allows the loops to stand proud or upright for subsequent processing. This technique also helps to ensure that a sufficient number of fibers are retained on the back side of the substrate 14 to allow for the needled loops to be adequately anchored in a manner described in greater detail below.

Referring again to FIG. 1, the needled web 88 leaves the needling station 18 and brush apron 22 in an unbonded state, and proceeds to a lamination station 92. Prior to reaching the lamination station 92, the needled web 88 passes over a gamma gage that provides a rough measure of the mass per unit area of the web. This measurement can be used as feedback to control the upstream carding and cross-lapping operations to provide more or fewer fibers based on the mass per unit area. Although the needled web 88 is in an unbonded state, it is stable enough to be accumulated in an accumulator 90 between the needling station 18 and the lamination station 92.

Figure 4:
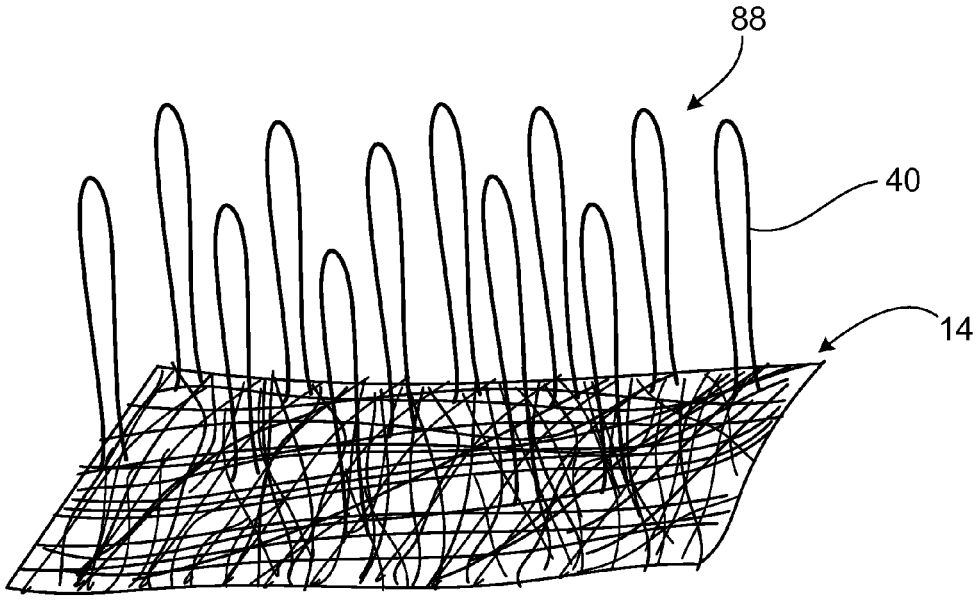
FIG. 4 is a schematic illustration of the front (loop) surface of a needled loop material, showing loop structures formed by needling staple fibers from the back surface of the material during the process of FIG. 1.

FIG. 4 shows the needled web 88 that leaves the needling station 18 having multiple loops 40 extending through the carrier sheet 14, as formed by the above-described needling. As shown, the loops 40 stand proud of the underlying carrier sheet 14 and are fairly evenly distributed, due at least in part to the coarseness of the fibers 12 and the needling process during which only one fiber 12 is pushed through the carrier sheet 14 per needle. The coarseness of the fibers 12 can also increase stiffness of the loops, which is beneficial for subsequent processing steps. For example, the resultant vertical stiffness of the loops can act to resist permanent crushing or flattening of the loop structures during subsequent processing steps when the loop material is laminated, or flattening of the subsequently formed mushroom-shaped fastener elements when the finished loop-engageable product is later joined to a loop product and compressed for packaging. Resiliency of the loops 40, especially at their juncture with the carrier sheet 14, enables loops 40 that have been "toppled" by heavy crush loads to right themselves when the load is removed.

Figure 5:
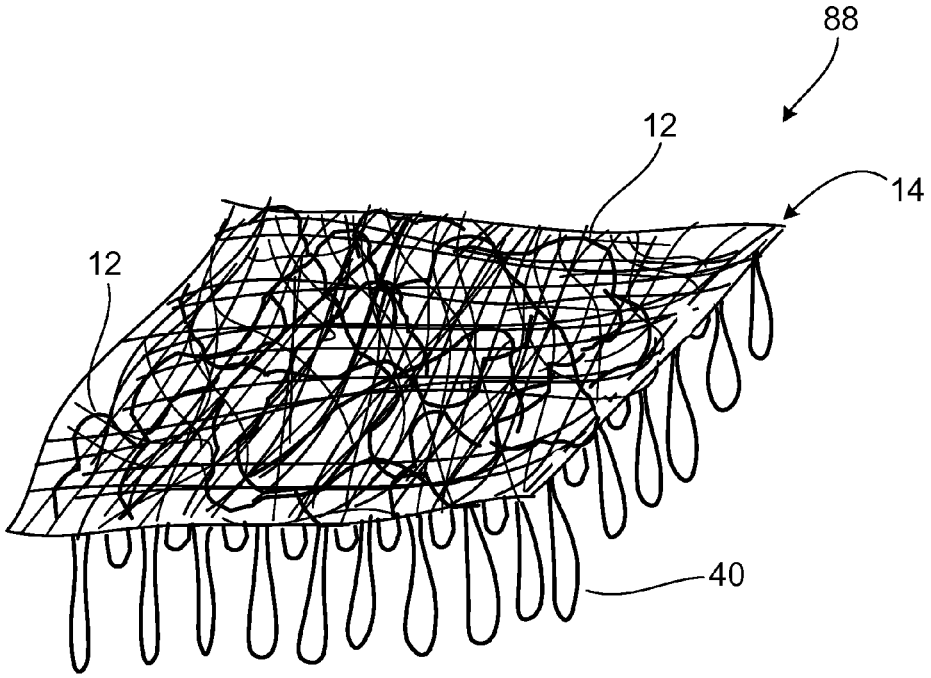
FIG. 5 is a schematic illustration of the back surface of the needled loop material formed during the process of FIG. 1.

By contrast, as shown in FIG. 5, the back surface of the needled web 88 is relatively flat, void of extending loop structures. Forming loop material in this manner reduces the amount of fiber and overall material required. Reducing the amount of material required further reduces the overall cost and increases the drapeability of the resulting loop-engageable material.

Referring back to FIG. 1, after leaving the accumulator 90 the needled web 88 passes through a spreading roll that spreads and centers the needled web 88 prior to entering the lamination station 92. In the lamination station 92, the needled web 88 passes by one or more infrared heaters 94 that preheat the fibers 12 and/or the carrier sheet 14 from the side opposite the loops. The heater length and line speed are such that the needled web 88 spends about four seconds in front of the infrared heaters 94. Two scroll rolls 93 are positioned just prior to the infrared heaters 94. The scroll rolls 93 each have a herringbone helical pattern on their surfaces and rotate in a direction opposite to the direction of travel of the needled web 88, and are typically driven with a surface speed that is four to five times that of the surface speed of the needled web 88. The scroll rolls 93 put a small amount of drag on the material, and help to dewrinkle the needled web 88. Just downstream of the infrared heaters 94 is a web temperature sensor that provides feedback to the heater control to maintain a desired web exit temperature.

During lamination, the heated, needled web 88 is trained about a 20 inch (50 centimeter) diameter hot can 96 against which four idler rolls 98 of five inch (13 centimeter) solid diameter, and a driven, rubber roll 100 of 18 inch (46 centimeter) diameter, rotate under controlled pressure. Idler rolls 98 are optional and may be omitted if desired. Alternatively, light tension in the needled web 88 can supply a light and consistent pressure between the needled web 88 and the hot can 96 surface prior to the nip with rubber roll 100, to help to soften the bonding fiber surfaces prior to lamination pressure. The rubber roll 100 presses the needled web 88 against the surface of hot can 96 uniformly over a relatively long 'kiss' or contact area, bonding the fibers over substantially the entire back side of the web.

The rubber roll 100 is cooled, as discussed below, to prevent overheating and crushing or fusing of the loop fibers on the front surface of the needled web 88, thereby allowing the loop fibers to remain exposed and standing upright so that the loop-ends can be removed to form stems and then the stems melted, as described below, to form mushroom-shaped fastener elements. The bonding pressure between the rubber roll 100 and the hot can 96 is quite low, in the range of about 1-50 pounds per square inch (psi) (70-3500 gsm) or less, typically about 15 to 40 psi (1050 to 2800 gsm) (e.g., about 25 psi (1750 gsm)). In order to bond the fibers 12 and carrier sheet 14, the surface of the hot can 96 is typically maintained at a temperature of about 306 degrees Fahrenheit (150 degrees Celsius). The needled web 88 is trained about an angle of around 300 degrees around the hot can 96, resulting in a dwell time against the hot can of about four seconds to avoid overly melting the needled web. The hot can 96 can have a compliant outer surface, or be in the form of a belt.

Figure 6:
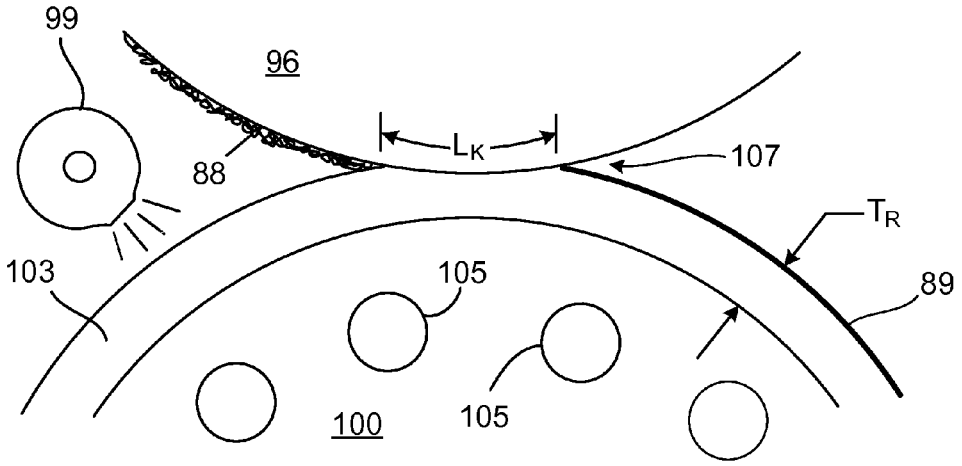
FIG. 6 is an enlarged diagrammatic view of a lamination nip through which the loop material passes during the process of FIG. 1.

FIG. 6 is an enlarged view of the nip 107 between hot can 96 and the rubber roll 100. As discussed above, due to the compliant nature of the rubber roll 100, uniform pressure and heat are applied to the entire back surface of the needled web 88, over a relatively large contact area. The hot can 96 contacts the fibers on the back side of the needled web 88 to fuse the fibers to each other and/or to fibers of the non-woven carrier sheet 14, forming a network of fused fibers extending over the entire back surface of the carrier sheet 14. The surface of the hot can 96, as noted above, is typically maintained at a temperature of about 306 degrees F. (150 degrees C.). The rubber roll 100 includes a rubber surface layer 103 that is positioned about and supported by a cooled steel core. The rubber surface layer 103 has a radial thickness $T_R$ of about 22 millimeters, and has a surface hardness of about 65 Shore A. Nip pressure is typically maintained between the rolls such that the nip kiss length $L_k$ about the circumference of hot can 96 is about 25 millimeters, with a nip dwell time of about 75 milliseconds. Leaving the nip, a laminated web 89 travels on the surface of the cooled roll 100. To cool the cooled rolled 100, liquid coolant is circulated through cooling channels 105 in the steel core to maintain a core temperature of about 55 degrees F. (12.7 degrees C.) while an air plenum 99 discharges multiple jets of air against the rubber roll surface to maintain a rubber surface temperature of about 140 degrees F. (60 degrees C.) entering nip 107.

The back surface of the loop material leaving the nip (i.e., the laminated web 89) is fused and relatively flat. The individual fibers tend to maintain their longitudinal molecular orientation through the bond points. The bond point network is therefore random and sufficiently dense to effectively anchor the fiber portions extending through the non-woven carrier sheet to the front side to form engageable loop formations. However, the bond point network is not so dense that the laminated web 89 becomes air-impermeable. Due to the distribution of bond points, the resulting loop-engageable fastener product will typically have a soft hand and working flexibility for use in applications where textile properties are desired. In other applications it may be acceptable or desirable to fuse the fibers to form a solid mass on the back side of the laminated web 89. The fused network of bond points creates a very strong, dimensionally stable laminated web 89 of fused fibers across the non-working side of the laminated web 89 that is still sufficiently flexible for many uses.

Referring back to FIG. 1, from the lamination station 92, the laminated web 89 moves through another accumulator 90 and on to a loop-end removing station 102, where the loop-ends of the formed loops on the front surface are removed to form stems. In the loop-end removing station 102, the laminated web 89 is passed by a blade device (e.g., a carpet shear) 150 that trims the outward most portions of the loops to form stems. Typically, the end of each loop is removed, leaving two stems per loop. The blade device 150 includes one or more articulating blade members that move relative to the loops to cut the ends of the loops. The blade device 150 can, for example, include a spiral cutter head and nose bar that cooperate to effect shearing of the loop ends in much the same way as carpet shears and manual push lawn mowers. The blade device 150 is positioned close enough to the needled web so that it properly removes the loop-ends, but not so close that it removes a substantial portion of the loops. Typically, the blade device 150 is positioned to remove about the top third of each exposed loop. However, the blade device 150 can be configured to remove any desired portion of the exposed loops, depending on the desired height of the loop-engageable fastener elements to be formed.

Figure 7:
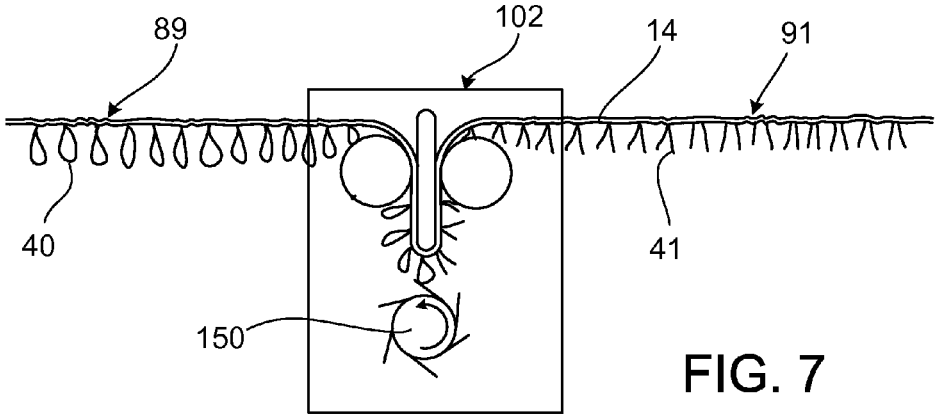
FIG. 7 is an enlarged schematic illustration of laminated loop material passing through a loop-end removing station to form a stem material during the process of FIG. 1.

FIG. 7 schematically illustrates the laminated web 89 before entering the loop-end removing station 102 and a stem web 91 after leaving the loop-end removing station 102. As shown, instead of the loops 40, the stem web 91 now has stems 41 along the front side that extend from the carrier sheet 14. Due to the loop-end removing process, the stems 41 are slightly shorter than the previously formed loop. For example, the stems 41, on average, can have a height that is 0.5-1.0 millimeter shorter than the average loop height.

As described above, the fibers 12 are typically coarse, drawn fibers (e.g., polypropylene fibers having a titer of 70-110 dtex). Due in part to the coarseness of the fibers, the stems generally stand up straight after having the loop-ends removed instead of falling down limp or substantially bending.

Referring back to FIG. 1, from the loop-end removing station 102, the stem web 91 moves through another accumulator 90 and on to a melting station 103. In the melting station 103, the free ends of the stems protruding from the carrier sheet 14 on the front side of the stem web 91 are melted to form mushroom-shaped fastener elements.

Figure 8:
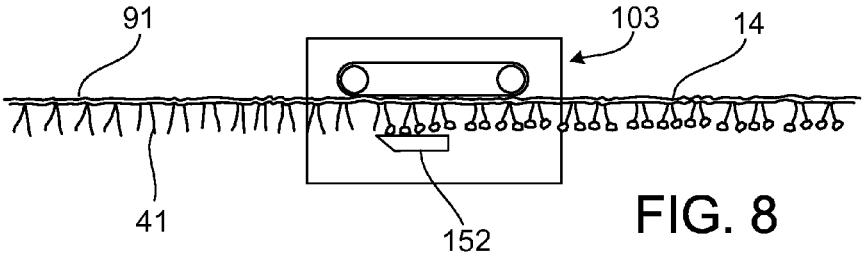
FIG. 8 is an enlarged schematic illustration of the stem material passing through a melting station to form mushroom-shaped heads on the stems during the process of FIG. 1.

FIG. 8 shows enlarged schematic of the stem web 91 before entering the melting station 103 and the mushroom-shaped fastener web 95 after leaving the melting station 103. As shown, as the stem web 91 passes through the melting station 103, the free ends of the stems 41 pass by a heated blade 152 that applies heat to melt the ends of the stems. The heated blade is made from one or more metals, such as steel, and is typically heated to maintain an external temperature of approximately 400-600 degrees F. (204-315 degrees C.). The temperature of the heated blade 152 can be maintained by various devices or methods, such as electrical resistance heating. The heated blade is positioned at a distance away from the stem web 91 so that the ends of the stems barely contact the heated blade in order to prevent the entire stem from being crushed and pressed against the front side of the carrier sheet 14 or from fully melting and collapsing onto the carrier sheet 14. In some cases, the heated blade 152 can melt the stems without actually contacting the ends of the stems, by applying radiant heat.

Since the fibers 12 are drawn polypropylene fibers, the fibers tend to have increased strength and stiffness, and the polymer chains of the fibers are typically aligned in the longitudinal direction. Therefore, as shown in FIG. 8, instead of forming a non-uniform, globule-like end when melted, the fibers 12 form somewhat uniform mushroom-shaped ends due to the aligned polymer chains. Using a loop-engageable fastener material having uniform mushroom-shaped fastener elements can result in better engagement and higher closure strength between the loop-engageable fastener material and a loop material.

Figure 9:
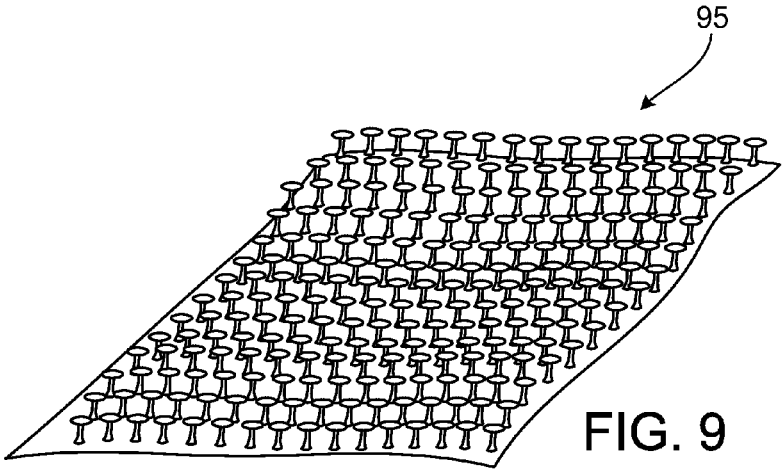
FIG. 9 is a perspective view of a front surface of mushroom-shaped loop-engageable fastener material exiting the melting station during the process of FIG. 1.

The shape of the mushroom-shaped fastener element heads depends on the cross-sectional profile of the fibers used in the fiber mat 10. Typically, the final shape of the mushroom-shaped fastener element heads is similar to the shape of the fiber, but larger. Therefore, as shown in FIG. 9, when cylindrical fibers (i.e., fibers having a substantially circular cross-section) are used, the resulting mushroom-shaped fastener element heads are substantially uniform, cylinder-like elements. Since the heat source is positioned at a distance away from the ends of the stems to provide controlled heating, the end of the stem is melted to form a mushroom-shaped fastener element end having an average diameter that is approximately 1.5 to 4.0 times larger than the average diameter of the stem prior to melting. Similarly, the average height of the mushroom-shaped fastener element is close to (e.g., generally within an order of magnitude) the average diameter of the mushroom.

The shape and size of the mushroom-shaped fastener element heads can typically be adjusted by altering the heat applied to the stems, the duration of time that the stems are subjected to the heat (i.e., the speed at which the web is passed through the melting station 103), and/or an external cooling process that can be applied. Subjecting the stems to increased heat or reducing the speed that the stem web 91 passes through melting station 103 typically creates a larger mushroom-shaped fastener element head. Although the mushroom-shaped fastener elements can be formed using many different operating parameters, it has been found that lower temperature and prolonged exposure time typically leads to nicely formed mushroom-shaped fastener elements.

Referring back to FIG. 1, from the melting station 103 the mushroom-shaped fastener web 95 moves through another accumulator 90 and on to an embossing station 104 where, between two counter-rotating embossing rolls, a desired pattern of locally raised regions is embossed into the mushroom-shaped fastener web 95 to form an embossed web 97. In some cases, the mushroom-shaped fastener web 95 may move directly from the melting station 103 to the embossing station 104, without accumulation, so as to take advantage of any latent temperature increase caused by forming the mushroom-shaped fastener element ends. As shown in FIG. 1, the mushroom-shaped fastener web 95 is passed through a nip between a driven embossing roll 54 and a backup roll 56. The embossing roll 54 has a pattern of raised areas that permanently crush the mushroom-shaped fastener elements against the carrier sheet, and may even melt a portion of the fibers in those areas. Embossing may be employed simply to enhance the texture or aesthetic appeal of the final product. Generally, the mushroom-shaped fastener web 95 has sufficient strength and structural integrity so that embossing is not needed to (and typically does not) enhance the physical properties of a resulting embossed web (e.g., the loop-engageable fastener product 31).

In some cases, the backup roll 56 has a pattern of raised areas that mesh with dimples in the embossing roll 54, such that embossing results in a pattern of raised hills or convex regions on the front side, with corresponding concave regions on the non-working side of the mushroom-shaped fastener web 95, such that the embossed web 97 has a greater effective thickness than the pre-embossed mushroom-shaped fastener web 95.

Figure 10:
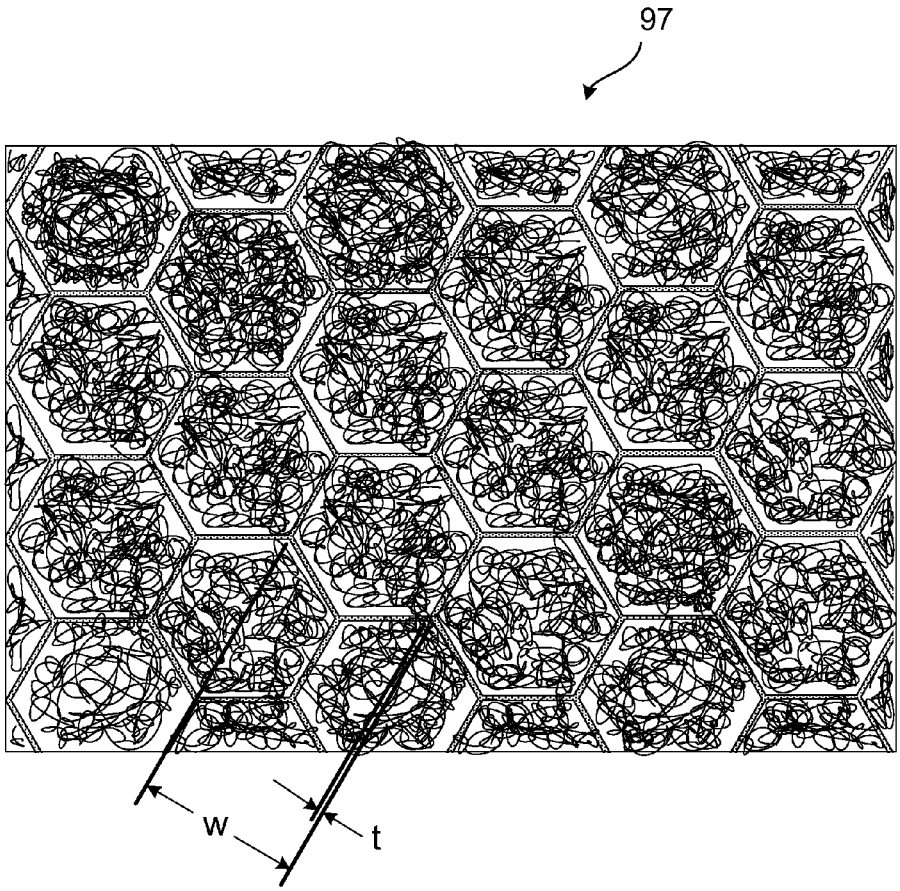
FIG. 10 is a planview of a mushroom-shaped loop-engageable fastener material having an embossed pattern on its front surface imparted by an embossing station during the process of FIG. 1.

As shown in FIG. 10, by way of an example, each cell of the embossing pattern in the embossed web 97 is a closed hexagon and contains multiple discrete mushroom-shaped fastener elements. The width 'W' between opposite sides of the open area of the cell is about 6.5 millimeters, while the thickness T of the wall of the cell is about 0.8 millimeter. Various other embossing patterns can be created, for example, a grid of intersecting lines forming squares or diamonds, or a pattern that crushes the mushroom-shaped fastener elements other than in discrete regions of a desired shape, such as round pads of mushroom-shaped fastener elements. The embossing pattern may also crush the mushroom-shaped fastener elements to form a desired image, or text, on the hook material.

Referring back to FIG. 1, from the embossing station 104, the loop-engageable fastener product 31 moves through a final accumulator 90 and past a metal detector 106 that checks for any broken needles or other metal debris that could become lodged in the fastener product during manufacturing. After passing by the metal detector 106, the loop-engageable fastener product 31 is slit to desired final widths and spooled for storage or shipment. During slitting, edges may be trimmed and removed, as can any undesired carrier sheet overlap region necessitated by using multiple parallel strips of carrier sheet.

While certain embodiments have been described, other embodiments are possible.

While the process above has been described as forming a continuous array of mushroom-shaped fastener elements along the width of the carrier sheet, other patterns can be formed. In some embodiments, for needling longitudinally discontinuous regions of the material, such as to create discrete loop regions as discussed further below, the needling station can include needle boards populated with discrete lanes of needles separated by wide, needle-free lanes. Such needle looms are available from Oerlikon Neumag Austria GmbH of Linz, Austria, for example. Alternatively, in some embodiments, "on the fly" variable penetration needling looms, in conjunction with needle boards populated discontinuously, can be used to either form loops in only discrete areas along the carrier sheet or to alternatively to form loops of different heights. Variable penetration can be accomplished by altering the penetration depth of the needles during needling, including needling to depths at which the needles do not penetrate the carrier sheet. Such variable penetration needle looms are commercially available from Oerlikon (e.g., model no. NL11/SE) and Dilo, for example.

Figure 11:
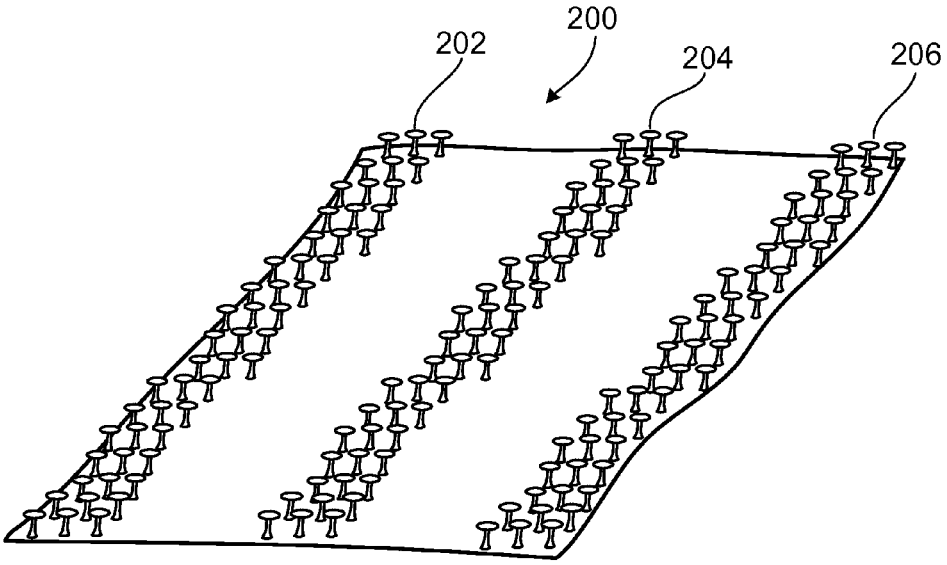
FIG. 11 is a perspective view of a front surface of a mushroom-shaped loop-engageable fastener material having lanes of mushroom-shaped fastener elements.

FIG. 11 shows a loop-engageable material 200 having discrete lanes 202, 204, 206 of mushroom-shaped fastener elements that can be formed using needle looms fitted with needleboards of the types discussed above. The mushroom-shaped fastener elements can be formed using a method similar to those described above. When the carrier sheet carrying fibers is passed through the needling station, the resulting needled product exiting the needling station has discrete lanes or strips of loops formed thereon. Along the portions of the carrier sheet where the fibers are not needled through the carrier sheet, the majority of the fibers remain loosely laid on top of the carrier sheet. As the web exits the needling station, the fibers in the non-needled portions are vacuumed away and can be reused in subsequent processing. The needled web having lanes of loops continues on to the subsequent stations (e.g., the lamination station, the loop-end removing station, and the melting station) to produce the lanes 202, 204, 206 of mushroom-shaped fastener elements.

Figure 12:
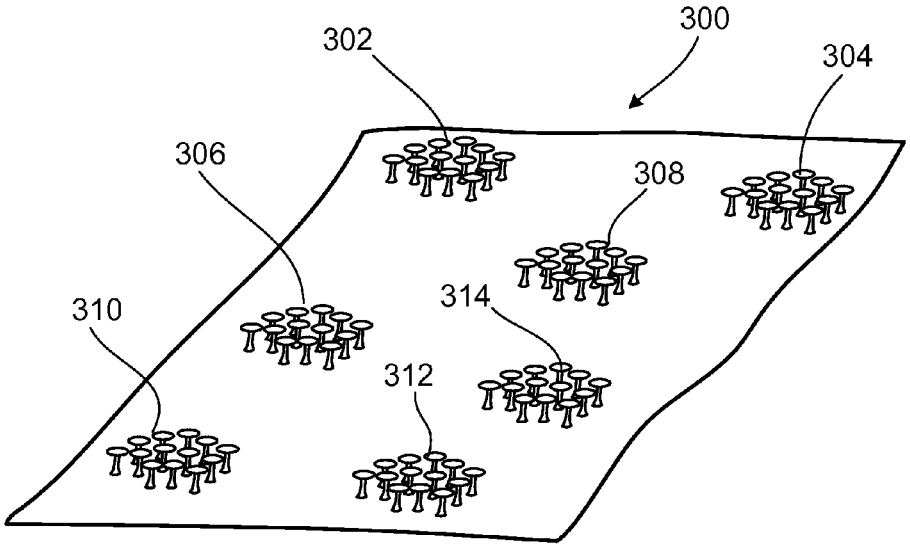
FIG. 12 is a perspective view of a front surface of a mushroom-shaped loop-engageable fastener material having islands of mushroom-shaped fastener elements.

In addition to creating discrete lanes of mushroom-shaped fastener elements, other types of patterns can be formed. As shown in FIG. 12, for example, a loop engagement material 300 includes discontinuous regions of loop-engageable elements can be in the form of discrete islands 302, 304, 306, 308, 310, 312, 314 of mushroom-shaped fastener elements. To form such discontinuous regions, as the carrier sheet and fibers pass though the needling station, needle boards containing discontinuous patterns of needles are installed in the needle loom, and the penetration depth of the needles is controlled and systematically changed at intervals from full penetration depth to less than zero (i.e., to not capture any fibers or penetrate the carrier sheet). For example, the needle loom can be a computer-operated device that is programmed to cause the needles to move in a desired manner. By selectively penetrating the fibers and the carrier sheet, "islands" of needled areas are produced, leaving areas of un-needled fibers. Similar to forming discrete strips of loops, the un-needled fibers can be vacuumed away and used in subsequent processing. The web with needled islands continues on to the subsequent stations (e.g., the lamination station, the loop-end removing station, and the melting station) and become islands of mushroom-shaped fastener elements. The shapes, designs, and patterns of islands can vary based on the needs of the end user. For example, islands can be in the form of chevrons, checkerboards, assembly instructions, or logos.

Figure 13:
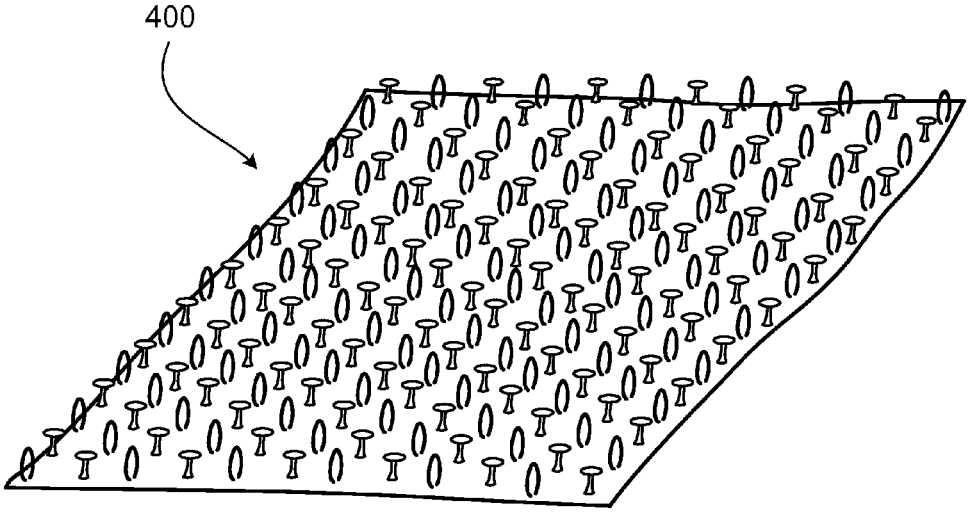
FIG. 13 is a perspective view of a front surface of a self-engaging fastener material having both mushroom-shaped loop-engageable fastener elements and loops.

FIG. 13 shows a hook-and-loop-engageable material 400 having both mushroom-shaped fastener elements and loops. Such materials can be used to releasably engage either hook material or loop material. To create such a material, fibers are needled through the carrier sheet to form multiple sets of loops having at least two different heights (i.e., shorter loops and taller loops). The different height loops can be formed by selectively penetrating the needles to two different penetration depths to form the shorter loops that are typically 2-4 mm (e.g., 4 mm) and the taller loops that are typically 5-8 mm (e.g., 8 mm). The needle loom can, for example, be programmed to automatically needle in this manner. Alternatively, the fibers and carrier sheet can be passed through two different looms, one in which the needles penetrate to form the shorter loops, and one in which the needles penetrate to form the taller loops.

Once two sets of loops are formed, the needled web moves on to the loop-end removing station. Unlike the process described above where substantially all of the loop-ends are removed to form stems, the loop-end removing station, due to the positioning of the blade device, only removes the loop-ends of the taller of the two different height loops (e.g., the 8 mm loop). After removing the loop-ends of the taller loops, the web contains both loops and stems. The loop and stem web can then move on to the melting station. Again, instead of processing both sets of loops, in the melting station only some of the stems (e.g., the stems formed of the 8 mm loops and not the smaller 4 mm loops) are melted at the ends to form mushroom heads. After removing the ends from some of the loops (e.g., from the 8 mm loops) to form stems and then melting the stems to form mushroom-shaped loop-engageable fastener elements, the resulting self-engaging touch faster material has loops that are about the same height or only slightly shorter than mushroom-shaped fastener elements. For example, the loops can be approximately 4 mm tall and the mushroom-shaped loop-engageable fastener elements can be approximately 5 mm tall. The distribution of loops and stems with mushroom-shaped fastener elements is controlled and can be adjusted by needling more or fewer of the taller loops. The ratio of loops to stems with mushroom-shaped fastener elements is typically about 1:1, but can be adjusted to include more or fewer loops. For example, the ratio of loops to stems can be from 1:3 to 3:1. In some examples, the melting station uses laser cutters to melt the ends of the stems in order to reduce the amount of residual heat which could possibly melt or deform the smaller 4 mm loops.

Although the process above has been described as including one needling station having a needle loom that can selectively needle fibers to form different sized loops, other methods for forming different sized loops can be performed. For example, in some embodiments, the process includes more than one (e.g., 2, 3, 4, 5, 6, 7, or more) needling stations having needle looms that are used to needle fibers through the carrier sheet, and in some cases, to needle fibers through the carrier sheet to different distances to form different sized loops. In some embodiments, each needling station includes more than one (e.g., 2, 4, or more) needle boards.

In some embodiments, the needle looms of the different needling stations include different sized needles to form different sized loops. The different sized needles can be distributed along a single needle board to form the different sized loops. In some embodiments, multiple needle boards are used that each include substantially only a certain sized needle. In some such embodiments, needles that are disposed along one particular needle board are a different size than the needles disposed along another needle board. Therefore, as the fibers and carrier sheet pass through multiple needling stations and/or pass by multiple needle boards within a single needling station sequentially, the different sized needles along the respective needle boards form different sized loops.

Alternatively or additionally, in some embodiments, forked needles and crown needles are both disposed along a needle board to form different height loops. Crown needles typically have barbs positioned along the sides of the needles, the barbs being spaced apart from an end of the needle to capture fibers along the side of the needle as opposed to a recess at the end of a forked needle. Therefore, due to the height difference of each of the respective needles, when a needle board including a distribution of similarly crown needles and forked needles penetrates a fiber mat, loops of different heights are formed.

Although the needling station has been described as including a bed of bristles extending from a driven support belt of brush apron that moves with the carrier sheet, other types of supports can be used. In some embodiments, the carrier sheet is supported by a screen or stitching plate that defines holes aligned with the needles, or alternatively, by a lamella plate.

Although the needling station has been described as including 38 gauge forked needles having a recess width of 100 microns, other needles having a larger recess can be used. For example, in some embodiments, needles having recess widths of 150-200 microns are used to capture fibers. As discussed above, the needle to be used will typically depend on the size of the fibers to be needled. In many cases, the needles will be sized to ensure that no more than one fiber is typically captured in the recess of each needle.

While many of the embodiments discussed above describe capturing only one fiber in each needle, in certain implementations, the needles are sized so that more than one fiber can be captured in each needle.

In addition, while all of the needled fibers are illustrated as forming loops in the embodiments discussed above, it should be understood that, in certain cases, the fibers will be needled through the substrate in a manner such that a loop will not be formed. For example, some of the fibers may be needled through the substrate in a manner such that only one end of the fiber remains on the back side of the substrate while the other end of the fiber is needled through the substrate, effectively forming a long stem. In such a case, the loop-end removing station will trim that fiber to the desired length and the melting station will melt the free end of that single fiber to form a mushroom-shaped loop-engageable fastener element.

Although the lamination station has been described as being positioned between the needling station and the loop-end removing station, the lamination station can alternatively be positioned at other locations. For example, in some embodiments, the lamination station is positioned after the loop-end removing station or after the melting station.

Although the lamination station has been described as including hot roller nips, other types of laminators can be used. In some embodiments, for example, a flatbed fabric laminator is used to apply a controlled lamination pressure for a considerable dwell time. Such flatbed laminators are available from Glenro Inc. in Paterson, N.J.

In certain embodiments, the finished loop product is passed through a cooler after lamination.

Although the loop-end removing station has been described as including a blade device, other devices that are capable of removing or trimming the ends of the loops can alternatively or additionally be used. Some examples of other suitable devices include laser cutting devices, hot wire knives, hot rolls, and radiant heating devices.

Although the melting station has been described as a heated blade that melts the ends of the stems by contact or by radiant heating, other heating devices or methods can alternatively or additionally be used. Some examples of other suitable heating devices include hot rolls, hot wire knives, laser cutting devices, flame generating devices, plasma devices, and other radiant heating devices.

Although the melting station has been described as including a heating device that is 400-600 degrees F., the heating device can be heated to temperatures that are lower or higher than 400-600 degrees F. For example, in some embodiments, the external temperature is 300-400 degrees F. (148-205 degrees C.) or greater than 600 degrees F. (315 degrees C.).

Although the process above has been described as having a loop-end removing station and a melting station, in some embodiments, a single device can be used to remove the loop-ends to create stems and to melt the free ends of the stems nearly simultaneously. For example, laser cutting devices, hot wire knives, hot rolls, and radiant heating devices can be used in this manner.

Although the process above has been described as including accumulators between various stations, in some cases, web material can move directly between stations without accumulation. In some embodiments, no accumulators are included between any of the various stations.

Although the fibers have been described as being polypropylene, other fiber materials can alternatively or additionally be used. For example, other fiber materials that can be used include polyolefins, polyesters, polyamides, and acrylics or mixtures, alloys, copolymers and/or co-extrusions of polyolefins, polyesters, polyamides, and acrylics. In some embodiments, the fibers are bicomponent fibers that are formed of high-density polyethylene and polypropylene. It has been found that such bicomponent fibers produce particularly high quality mushroom heads. It will be understood that the laminating station and the melting station will be operated at a temperature that exceeds the melting temperature of the selected fiber material to ensure that the fibers are properly anchored and the mushroom-shaped fastener element heads are properly formed.

Although the fibers have been described as being cylindrical or having a round cross-sectional profile, other fiber shapes can be used. In some embodiments, the fibers have a cross-sectional profile that further increases stiffness and enhances the ability of the fibers to stand up straight after being needled through the substrate. Such cross-sectional profiles include polygon-shaped profiles (e.g., triangles, rectangles, pentagons, hexagons), polygons having curved sides-shaped profiles (e.g., Reuleaux polygons), or polylobal-shaped profiles. As discussed above, the cross-sectional profile of the fibers can influence the final shape of mushroom-shaped fastener elements (i.e., the cross sectional profile of the mushroom-shaped fastener elements is typically the same as that of the fiber, but larger). Non-cylindrical fibers can be used to form non-cylindrical mushroom-shaped fastener elements having particular advantages. For example, in some embodiments, quadrilobe-shaped fibers are used so that the resulting fastener elements after melting form grapple hook-like fastener elements. When such non-cylindrical fibers are used, instead of being sized to match the diameter of the fibers, the recess of the forked needle is sized to match the diameter of the smallest imaginary circle that could circumscribe the cross-sectional profile of the fibers.

Figure 14:
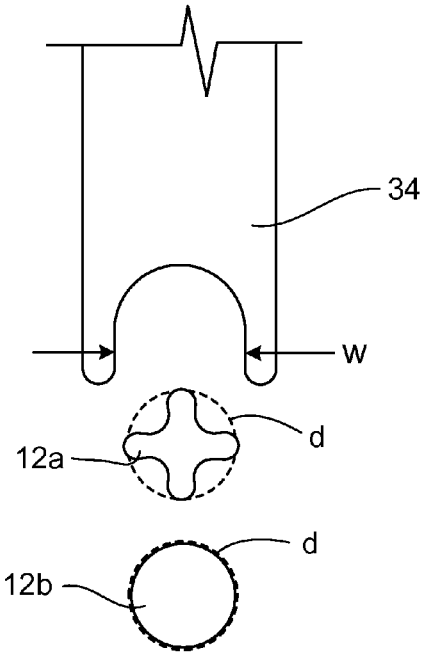
FIG. 14 is a diagrammatic cross-sectional view of different shaped fibers that can be captured by a forked needle.

FIG. 14 shows an example of a smallest imaginary circle (shown in dashed lines) having a diameter d that circumscribes the cross-sectional profile of a non-cylindrical fiber (e.g., a quadrilobe fiber shaped fiber) 12*a* and a cylindrical fiber 12*b* to be captured by a forked needle 34 having a recess width w. As shown, when cylindrical fibers 12*b* are used, the diameter d of the smallest imaginary circle that circumscribes the cross-sectional profile of the cylindrical fiber 12*b* is equal to the diameter of the cylindrical fibers 12*b*. As discussed above, a width w of the recess of the forked needle 34 can be selected based on the diameter d of the fiber or fibers to be used. The width w can, for example, be about 75% to about 125% of the diameter d to ensure that any one fiber is needled through the substrate to form a single loop.

Although the carrier sheet has been described as being a spunbond web made from a polymer, other materials may alternatively or additionally be used. For example, in some embodiments, the carrier sheet is formed of a thin film, paper, a textile such as scrim, a lightweight cotton sheet, or another non-woven, woven, or knit material.

In some embodiments, the carrier sheet is point bonded. The spunbond web may include a non-random pattern of fused areas, each fused area being surrounded by unfused areas. The fused areas may have any desired shape, e.g., diamonds or ovals, and are generally quite small, for example on the order of several millimeters.

In some embodiments, a pre-printed carrier sheet may be employed to provide graphic images visible from the front side of the finished product. This can be advantageous, for example, for loop-engageable materials to be used on children's products, such as disposable diapers. In such cases, child-friendly graphic images can be provided on the loop-engageable material that is permanently bonded across the front of the diaper chassis to form an engagement zone for the diaper tabs. The image can be pre-printed on either surface of the carrier sheet, but is generally printed on the front side. An added film may alternatively be pre-printed to add graphics, particularly if acceptable graphic clarity cannot be obtained on a lightweight carrier sheet such as a spunbond web.

Although the process above has been described as including embossing the loop-engageable fastener material to provide a textured pattern on the fastener material, in some embodiments, the resulting loop-engageable material is not embossed.

Although the process above has been described as including slitting the material into smaller rolls, in some embodiments, the fastener material is undivided and remains as large rolls. Undivided, larger rolls can be used for applications requiring a fastener material having a large surface area (e.g., for fastening home siding or roofing material). In some cases, large rolls can be up to 2-3 meters wide.

While the staple fibers have been described as being laminated to themselves and to the carrier sheet during lamination, in some embodiments, a binder can be used to anchor the fibers. The binder may be applied in liquid or powder form, and may even be pre-coated on the fiber side of the carrier web before the fibers are applied. Alternatively or additionally, if desired, a backing sheet can be introduced between the hot can and the needled web, such that the backing sheet is laminated over the back surface of the needled web while the fibers are bonded under pressure in the nip. Polymer backing layers or binders may be selected from among suitable polyethylenes, polyesters, EVA, polypropylenes, and their copolymers.

In some embodiments, advance per stroke is limited due to a number of constraints, including needle deflection and potential needle breakage. Thus, it may be difficult to accommodate increases in line speed and obtain an economical throughput by adjusting the advance per stroke. As a result, the holes pierced by the needles may become elongated, due to the travel of the carrier sheet while the needle is interacting with the carrier sheet (the "dwell time"). This elongation is generally undesirable, as it reduces the amount of support provided to the base of each of the loop structures by the surrounding substrate, and may adversely affect resistance to loop pull-out. Moreover, this elongation will tend to reduce the mechanical integrity of the carrier sheet due to excessive drafting (i.e., stretching of the carrier sheet in the machine direction and corresponding shrinkage in the cross-machine direction).

Figure 15:
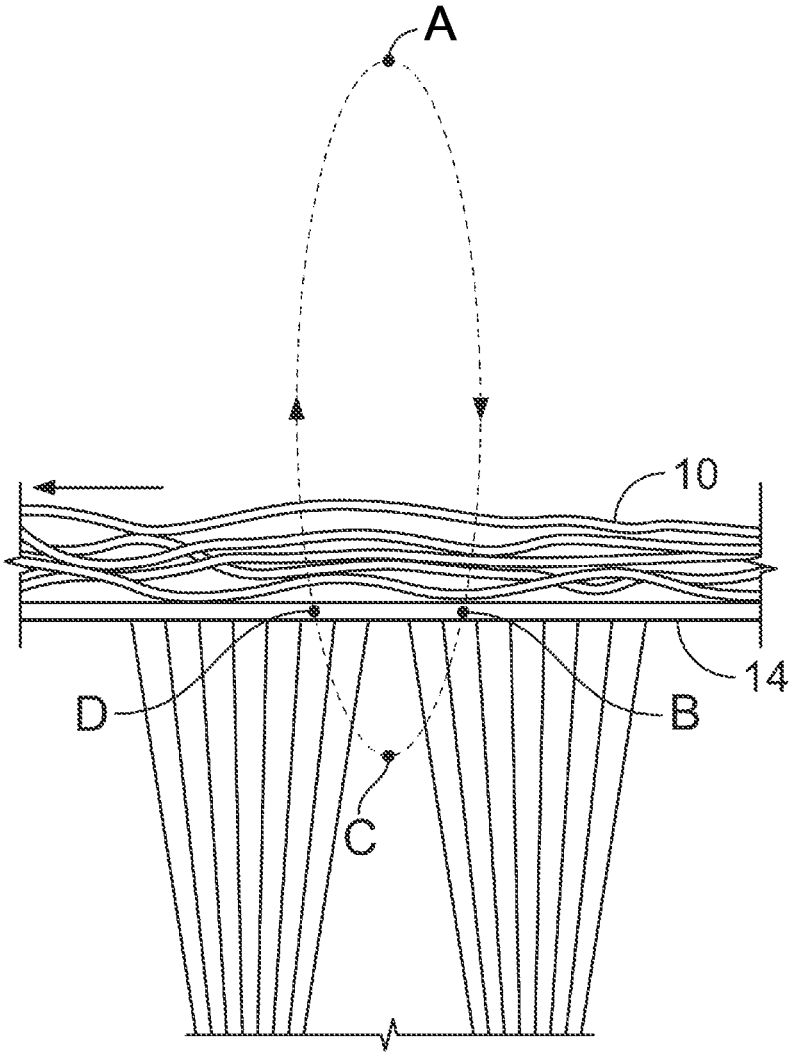
FIG. 15 is a diagrammatic side view of an elliptical needling process that can be used to needle fibers through a substrate during a process of forming mushroom-shaped loop-engageable fastener material.

Elongation of the holes may be reduced or eliminated by moving the needles in a generally elliptical path (e.g., when viewed from the side). This elliptical path is shown schematically in FIG. 15. As shown in FIG. 15, each needle begins at a top "dead center" position A, travels downward to pierce the carrier sheet (position B) and, while it remains in the carrier sheet (from position B through bottom "dead center" position C to position D), moves forward in the machine direction. When the needle has traveled upward sufficiently for its tip to have exited the pierced opening (position D), it continues to travel upward, free of the carrier sheet, while also returning horizontally (opposite to the machine direction) to its normal, rest position (position A), completing the elliptical path. This elliptical path of the needles is accomplished by moving the entire needle board simultaneously in both the horizontal and vertical directions. Needling in this manner is referred to herein as "elliptical needling." Needling looms that perform this function are available from DILO System Group, Eberbach, Germany, under the tradename "HYPERPUNCH Systems."

During elliptical needling, the horizontal travel of the needle board is generally a function of needle penetration depth, vertical stroke length, carrier sheet thickness, and advance per stroke, and is typically roughly equivalent to the distance that the carrier sheet advances during the dwell time. Generally, at a given value of needle penetration and carrier sheet thickness, horizontal stroke increases with increasing advance per stroke. At a fixed advance per stroke, the horizontal stroke generally increases as depth of penetration and web thickness increases.

While the process above has been described above as including a first carding station, a cross-lapper, and a second carding station, other fiber preparation components and/or methods can be used. In some embodiments, instead of a first carding station and a cross lapper, a fiber bale opening machine and a fiber blending machine are used to prepare fibers and provide them to a single carding station.

While embodiments discussed above describe the formation of relatively short loop-engageable fastener elements, it should be understood that fastener elements of any of various sizes can be formed using the processes described herein.

In some embodiments, the materials of the loop-engageable product are selected for other desired properties. In some cases, the hook fibers, carrier web, and backing are all formed of polypropylene, making the finished hook product readily recyclable. In another example, the hook fibers, carrier web and backing are all of a biodegradable material, such that the finished hook product is more environmentally friendly. High tenacity fibers of biodegradable polylactic acid are available, for example, from Cargill Dow LLC under the trade name NATUREWORKS.

While the mushroom-shaped fastener elements discussed above have been described as loop-engageable fastener elements, in some embodiments, the mushroom-shaped fastener elements are configured to engage other mushroom-shaped fastener elements and are utilized in self-engaging fastener products.

Other embodiments are within the scope of the following claims.

What is claimed is:

1. A method of making a sheet-form loop-engageable fastener product, the method comprising placing a layer of staple fibers on a first side of a substrate;

needling fibers of the layer through the substrate by penetrating the substrate with fork needles that drag portions of the fibers through the substrate during needling, leaving exposed loops of the fibers extending from a second side of the substrate;

removing end regions from at least some of the loops to form stems; and forming loop-engageable heads at free ends of at least some of the stems;

wherein each of the fork needles has a recess formed between tines, and the recess of each of the fork needles has a width that is about 75% to about 125% of a diameter of a circle that circumscribes one of the staple fibers.

2. The method according to claim 1, further comprising anchoring fibers forming the loops by fusing the fibers to each other on the first side of the substrate, while substantially preventing fusion of the fibers on the second side of the substrate.

3. The method according to claim 1, further comprising matching the needles to the fibers so that each of the needles captures no more than one fiber per needle stroke.

4. The method according to claim 1, wherein the recess of each needle has a width of 80-100 microns to capture a single fiber having a titer of 60-110 dtex.

5. The method according to claim 1, wherein the fibers have a titer of 60-600 dtex.

6. The method according to claim 1, wherein the staple fibers are disposed on the substrate in a carded, unbonded state.

7. The method according to claim 1, wherein the substrate comprises a nonwoven web.

8. The method according to claim 1, wherein the loops formed on the second side of the substrate are formed such that substantially only one loop protrudes through each hole in the substrate so that the loops extend substantially perpendicular to the substrate.

9. The method according to claim 1, wherein removing end regions from at least some of the loops to form stems comprises cutting the end regions off with a blade.

10. The method according to claim 1, wherein forming loop-engageable heads at the ends of at least some of the stems comprises melting the ends of the at least some of the stems.

11. The method according to claim 1, wherein removing end regions and forming loop-engageable heads are performed substantially simultaneously using a single device.

12. The method according to claim 1, wherein needling fibers of the layer through the substrate comprises needling fibers to form taller loops and needling fibers to form shorter loops having a second height, and end regions of the taller loops are removed to form the stems.

13. The method according to claim 12, wherein needling fibers to form taller loops and needling fibers to form shorter loops having a second height comprises using different sized needles disposed along a common needle board.

14. The method according to claim 12, wherein the loops and the stems with loop-engageable heads are substantially evenly distributed along the substrate.

15. The method according to claim 12, wherein the ratio of loops to stems with loop-engageable heads disposed along the substrate is 1:1 to 3:1.

16. The method according to claim 12, wherein the first height is 5-8 mm and the second height is 2-4 mm.

17. The method according to claim 12, wherein discrete patterns of larger loops are formed during needling to form pairs of stems with loop-engageable heads along the substrate.

18. The method according to claim 1, wherein needling the fibers of the layer through the substrate comprises selectively needling the fibers to form discrete regions of loops.

19. The method according to claim 18, wherein the discrete regions comprise islands that include groupings of multiple loops that are surrounded by regions free of loops.

20. The method according to claim 18, wherein the discrete regions comprise lanes of loops, the lanes being separated by parallel regions that are free of loops.

21. The method according to claim 18, wherein selectively needling the fibers to form discrete regions of loops comprises moving needles different distances with respect to the substrate such that a first portion of needles push some fibers through the substrate to form the loops and a second portion of needles do not penetrate the substrate.

22. The method according to claim 18, wherein selectively needing the fibers to form discrete regions of loops comprises using needle boards having discrete regions of needles that are separated by regions that are free of needles.

23. A method of making a sheet-form loop-engageable fastener product, the method comprising placing a layer of staple fibers on a first side of a substrate;

needling fibers of the layer through the substrate by penetrating the substrate with needles that drag portions of the fibers through the substrate during needling, leaving exposed loops of the fibers extending from a second side of the substrate;

removing end regions from at least some of the loops to form stems; and forming loop-engageable heads at free ends of at least some of the stems, wherein the needles are sized so that no more than one fiber is needled through the substrate per needle.

24. The method according to claim 23, further comprising matching the needles to the fibers so that each of the needles captures no more than one fiber per needle stroke.

25. The method according to claim 23, wherein the recess of each needle has a width of 80-100 microns to capture a single fiber having a titer of 60-110 dtex.

26. The method according to claim 23, wherein the fibers have a titer of 60-600 dtex.

27. The method according to claim 23, wherein the staple fibers are disposed on the substrate in a carded, unbonded state.

28. The method according to claim 23, wherein the substrate comprises a nonwoven web.

* * * * *